US007074121B2

(12) United States Patent
Zhou et al.

(10) Patent No.: US 7,074,121 B2
(45) Date of Patent: Jul. 11, 2006

(54) HOMOGENEOUS VENT CAP

(76) Inventors: Yingying Zhou, 645 Breconshire La., Coralville, IA (US) 52241; Dosun Shin, 809 W. Grove Pkwy., #1130, Tempe, AZ (US) 85283; Brian Erickson, 12820 25th St. Ct., Milan, IL (US) 61264

( * ) Notice: Subject to any disclaimer, the term of this patent is extended or adjusted under 35 U.S.C. 154(b) by 0 days.

(21) Appl. No.: 10/888,338

(22) Filed: Jul. 7, 2004

(65) Prior Publication Data

US 2006/0009146 A1 Jan. 12, 2006

(51) Int. Cl.
*F23L 17/04* (2006.01)

(52) U.S. Cl. ..... 454/8

(58) Field of Classification Search ..... 126/85 B; 454/8

See application file for complete search history.

(56) References Cited

U.S. PATENT DOCUMENTS

| | | | | |
|---|---|---|---|---|
| D53,050 | S | 3/1919 | Scherer | |
| 2,964,034 | A | 12/1960 | Nordholt et al. | |
| 2,966,838 | A | 1/1961 | Thompson et al. | |
| 3,099,900 | A | 8/1963 | Beck | |
| 3,105,432 | A | 10/1963 | Chamberlain | |
| 3,192,852 | A | 7/1965 | Stark et al. | |
| 3,315,586 | A | 4/1967 | Marrapese et al. | |
| 3,654,913 | A | 4/1972 | Derringer et al. | |
| 3,727,539 | A | 4/1973 | Wilmes | |
| 3,874,363 | A | 4/1975 | Biedenbender et al. | |
| 4,016,730 | A | 4/1977 | DeVilliers | |
| D261,924 | S | 11/1981 | Donohue | |
| 4,690,129 | A | 9/1987 | Halstead | |
| 4,940,042 | A | 7/1990 | Moore, Jr. et al. | |
| 5,261,389 | A * | 11/1993 | Trieb | 126/85 B |
| 5,562,088 | A | 10/1996 | Valters et al. | |
| 5,715,808 | A | 2/1998 | Wilhoite | |
| 6,053,162 | A * | 4/2000 | Godfree et al. | 126/85 B |
| 6,289,886 | B1 | 9/2001 | Radke | |
| D462,436 | S | 9/2002 | Bennett et al. | |
| 6,484,712 | B1 | 11/2002 | Lyons et al. | |
| 6,647,977 | B1 * | 11/2003 | Lesage | 126/85 B |

* cited by examiner

*Primary Examiner*—Gregory Wilson
(74) *Attorney, Agent, or Firm*—Faegre & Benson, LLP

(57) ABSTRACT

A vent assembly for use with a vent pipe assembly that includes an intake member defining an intake aperture and an exhaust member defining an exhaust aperture. The vent assembly may include a flow guide positioned adjacent to the intake aperture and configured to direct fluid flow into the intake aperture, a divider positioned between the exhaust aperture and the intake aperture and configured to minimize fluid flow between the exhaust aperture and the intake aperture, and a wind shield coupled to a distal end of the exhaust member adjacent to the exhaust aperture and configured to minimize reverse flow into the exhaust aperture. The vent assembly is configured to minimize the flow of fluids exhausted from the exhaust aperture into the intake aperture, to minimize reverse flow in the exhaust member, and to improve the flow of intake air into the intake aperture.

18 Claims, 5 Drawing Sheets

HOMOGENEOUS VENT CAP

BACKGROUND OF THE INVENTION

1. Field of the Invention

The present invention generally relates to components of a vent system for a heating appliance, and more particularly relates to a vent structure that provides vent cap and vent cover functionality and is suited for use with a vent system with an exhaust vent opening and intake vent opening.

2. Related Art

Exterior intake and/or exhaust venting systems are generally known for use in buildings and other such structures. Such vents can be used for a variety of venting purposes, for example, to vent fireplaces, furnaces, water heaters, boilers, dryers, exhaust fans, and a many other such appliances and devices. Some such vents are primarily exhaust vents while others are primarily intake vents, and still others include structure that allows them to function as both intake and exhaust vents.

In one example, chimneyless gas fireplaces often include intake/exhaust venting units that are mounted on the outside of an exterior wall that provide a through-the-wall connection to a double walled collinear ducting of the gas fireplace. The double walled collinear ducting includes an inner duct that serves as an outtake port for exhaust fumes, and an outer duct that serves as an intake port for ambient combustion air. The venting units generally include an inner and an outer duct. Further, the double-walled ducting is connected to a series of bases that have deflectors and heat shields. The venting unit has a series of venting apertures with a vent cap attached thereto. The vent cap is utilized to cover both the air intake and the combustion product exhaust.

Regardless of the specific structure or use of the vent, most venting systems generally include a functional vent cap that covers the intake and exhaust portions of the vent. However, many of the existing vent caps are not aesthetically pleasing, may get hot due to high temperature exhaust gases, and are exposed to the ambient atmosphere and therefore may be damaged. An example venting unit that includes a functional vent cap and vent covers is shown and described in U.S. Pat. No. 6,484,712.

SUMMARY OF THE INVENTION

The present invention relates to vent assemblies suited for use with a vent that includes intake and exhaust apertures. The vent assemblies are configured to provide proper fluid flow into and out of the respective intake and exhaust apertures of the vent, minimize the flow of fluids exhausted from the exhaust aperture into the intake aperture, and to improve the flow of intake air into the intake aperture.

One aspect of the present invention relates to a venting system that includes a base including a generally outward facing primary surface and defining an intake opening and an exhaust opening that extend through the outwardly facing primary surface. The system also includes an intake duct and an exhaust duct oriented in a coaxial relationship with each other and with the intake and exhaust apertures, respectively, an end of the intake duct extending no further axially than the outward facing primary surface and an end of the exhaust duct extending axially beyond the outward facing primary surface. The system may further include a divider positioned between the exhaust and intake apertures, and a flow guide positioned between the divider and the base to direct intake air flow into the intake aperture.

Another aspect of the invention relates to a venting system that includes a vent duct that includes an intake member defining an intake aperture and an exhaust member defining an exhaust aperture, the exhaust member being positioned coaxially within the intake member, a divider positioned between the exhaust aperture and the intake aperture, the divider being configured to minimize flow between the exhaust aperture and the intake aperture, and a cover member configured to cover at least a portion of the exhaust aperture.

A further aspect of the invention relates to a vent assembly for use with a vent that includes an intake member defining an intake aperture and an exhaust member defining an exhaust aperture. The assembly may include a flow guide positioned adjacent to the intake aperture and configured to direct fluid flow into the intake aperture, a divider positioned between the exhaust aperture and the intake aperture and configured to minimize fluid flow between the exhaust aperture and the intake aperture, and a wind shield coupled to a distal end of the exhaust member adjacent to the exhaust aperture and configured to minimize reverse flow into the exhaust aperture.

A further aspect of the invention relates to a method of assembling a vent assembly that includes an exhaust member defining an exhaust aperture and an intake member defining an intake aperture. The method may include positioning a divider between the exhaust and intake apertures, positioning a flow guide between the divider and the intake apertures to direct air flow into the intake aperture, and coupling a wind shield to a distal end of the exhaust member adjacent to the exhaust aperture to minimize reverse flow into the exhaust aperture.

Another aspect of the invention relates to a method of controlling fluid flow in a vent assembly that includes an exhaust member defining an exhaust aperture and an intake member defining an intake aperture. The method may include positioning a divider between the intake and exhaust apertures to direct exhaust gases exiting the exhaust aperture away from the intake aperture, and positioning a guide member between the divider and the intake aperture to direct intake air into the intake aperture.

The above summary of the present invention is not intended to describe each disclosed embodiment or every implementation of the present invention. In particular, the example embodiments described below in relation to the Figures are the application of the present invention in a fireplace, whereas many other fields may be applicable to fulfill the purposes and intents of the present invention. Figures in the detailed description that follow more particularly exemplify certain embodiments of the invention. While certain embodiments will be illustrated and describe embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 1:
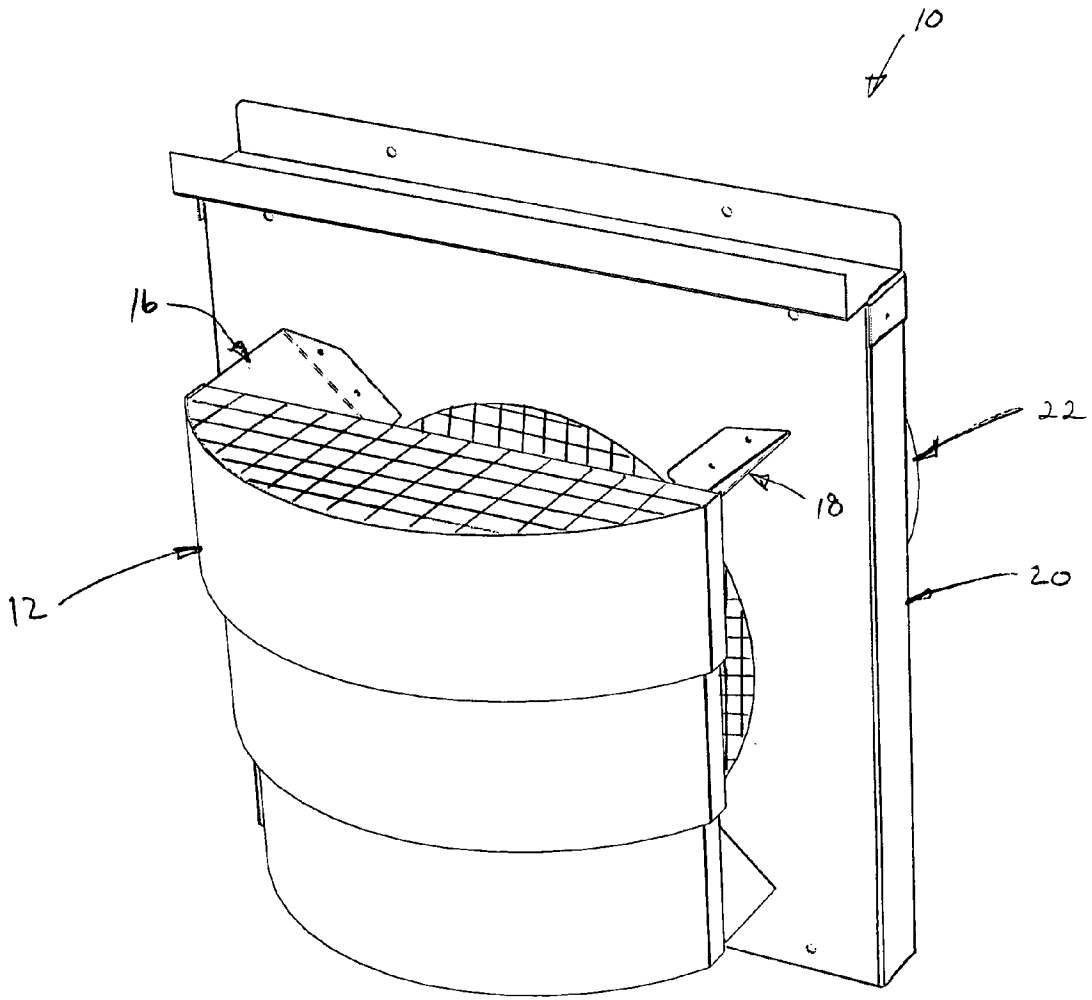
FIG. 1 is a perspective view of the vent assembly in a possible embodiment of the present invention.
Figure 2:
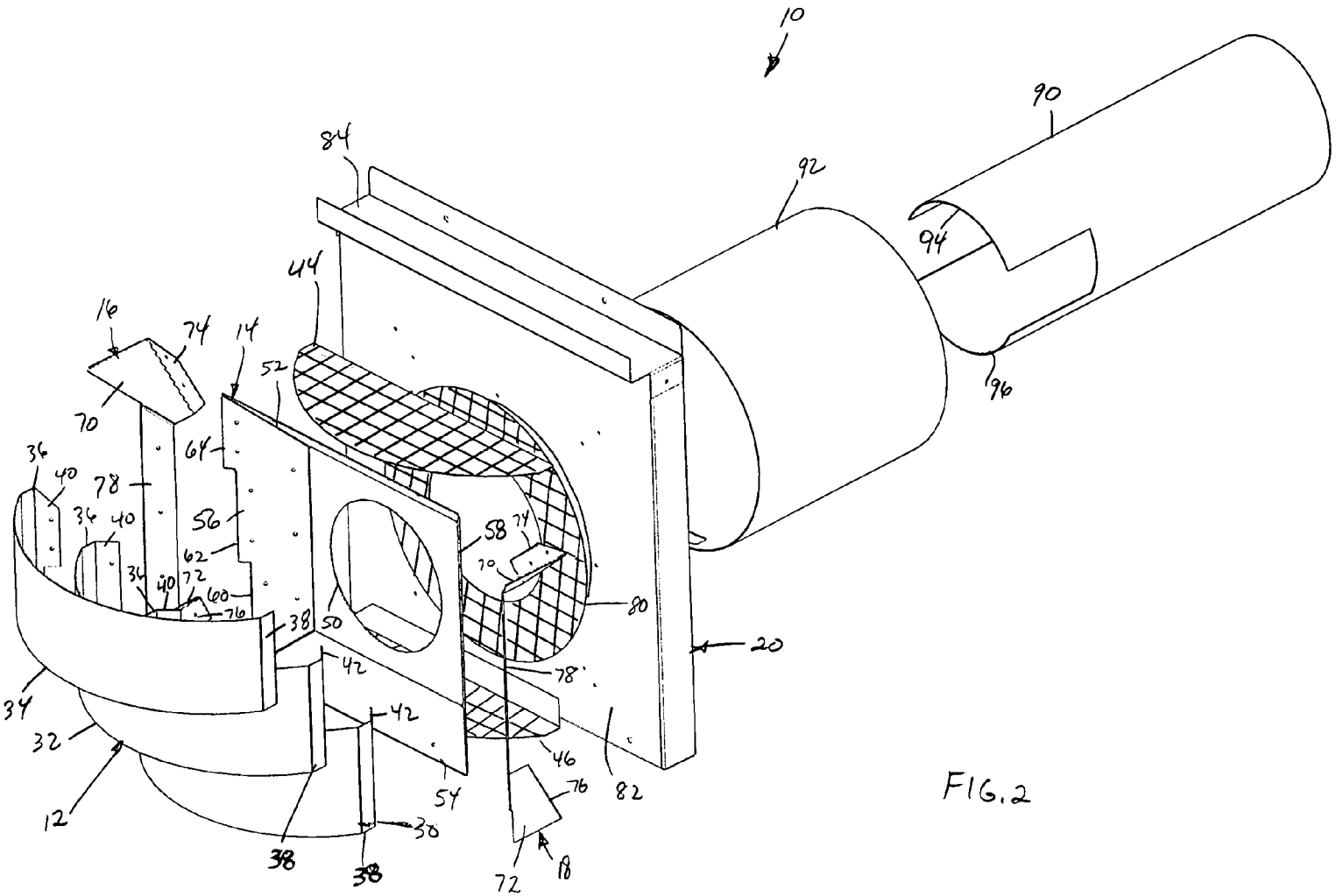
FIG. 2 is an exploded perspective view of the vent assembly of FIG. 1.
Figure 3:
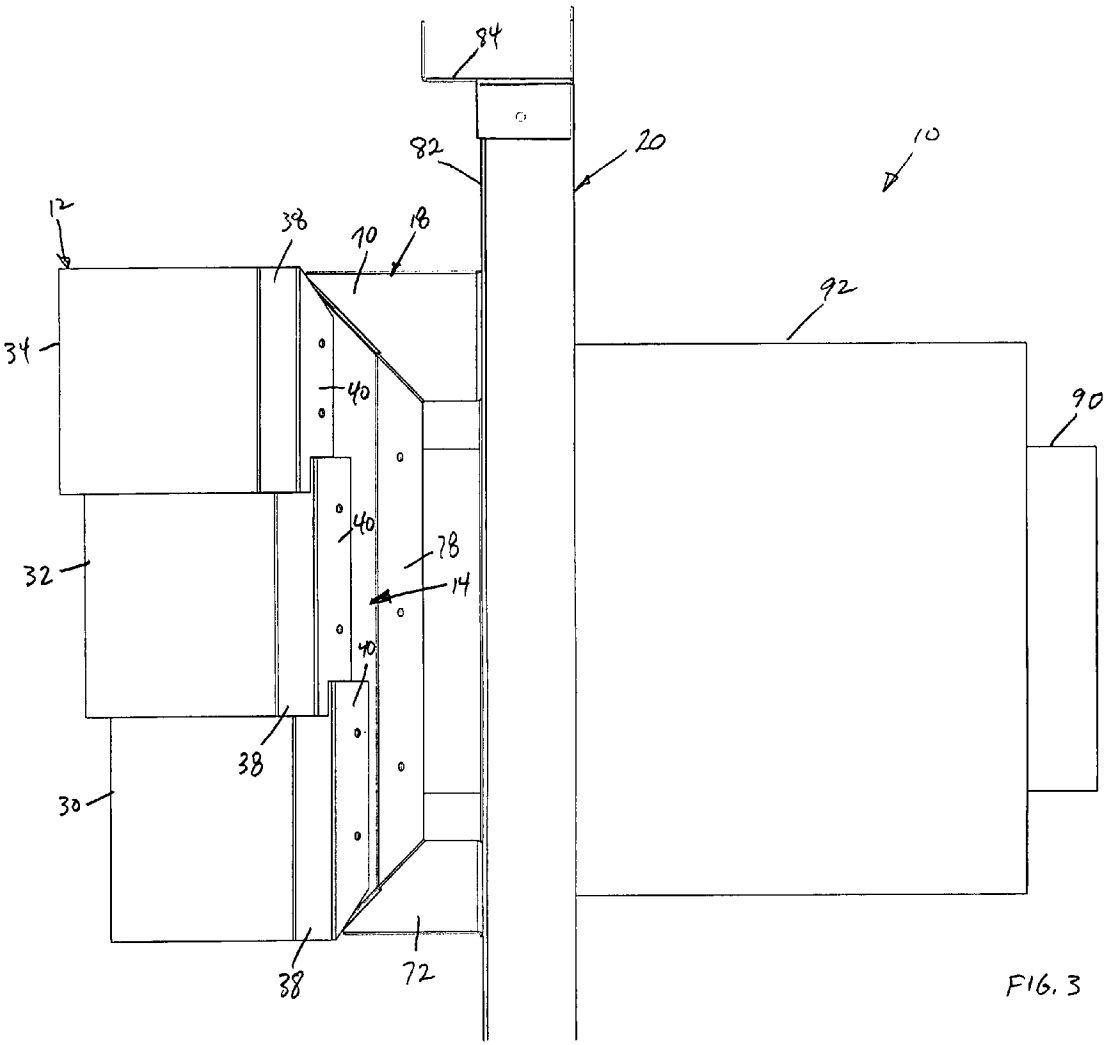
FIG. 3 is a side view of the vent assembly of FIG. 1.
Figure 4:
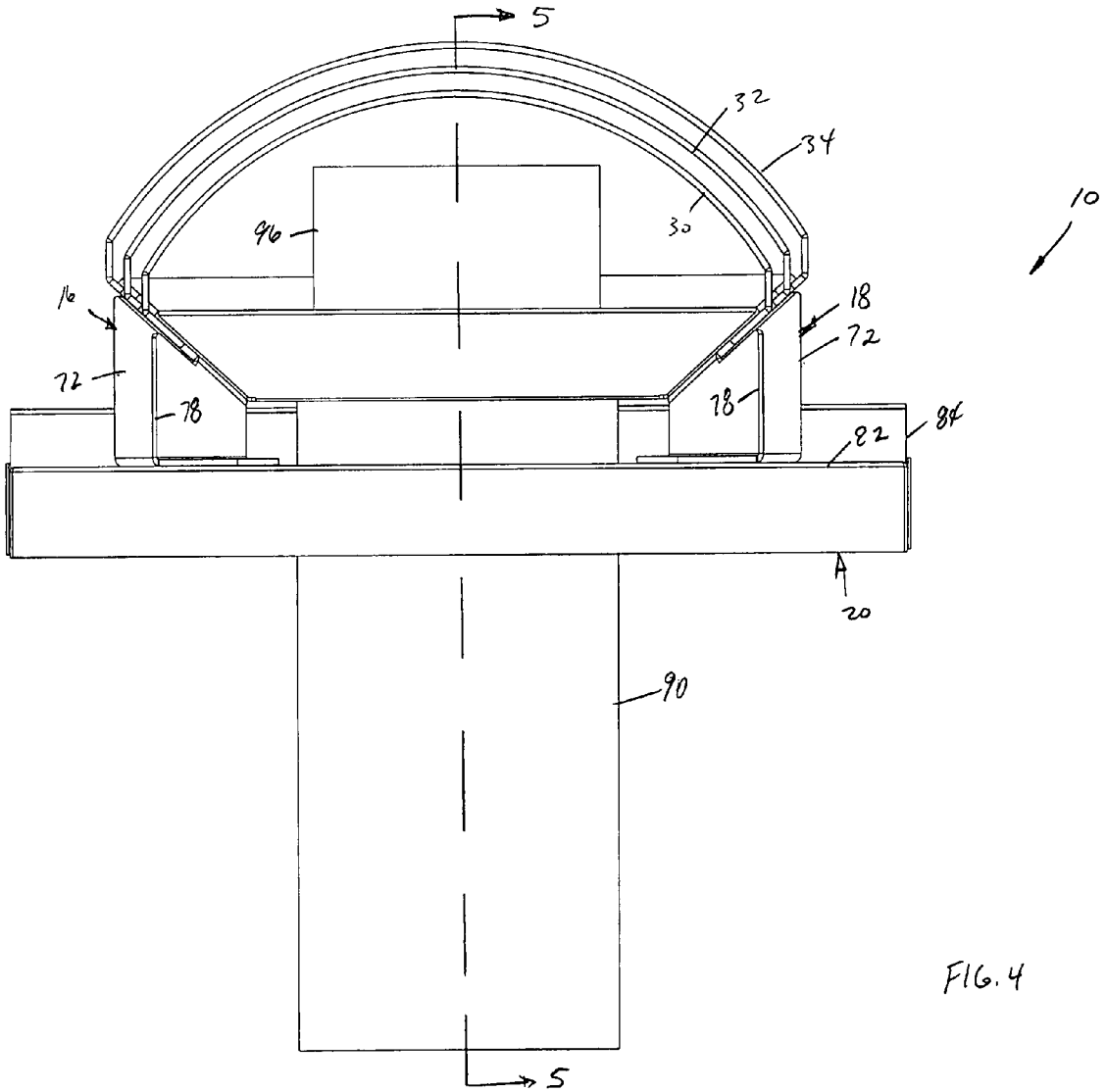
FIG. 4 is a bottom view of the vent assembly of FIG. 1 with the top and bottom screen members removed.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention generally relates to vents, vent covers, vent caps, and vent assemblies. Example embodiments described herein are directed to vent systems and structures that integrate features into a single configuration. The example systems include an exhaust member configured to deliver exhaust fluids, and an intake member configured to receive intake fluids. The exhaust and intake members are preferably coaxially oriented with the exhaust member extending within the intake member. This coaxial arrangement (sometimes referred to as a B-vent arrangement) may be well suited for cooling the exhaust gases in the exhaust member with the intake fluids flowing through the intake member. Other embodiments have included other arrangements of the exhaust and intake members relative to each other.

An example vent assembly 10 that illustrates principles of the present invention is shown in FIGS. 1–5. Venting system 10 includes a vent cover assembly 12, a divider 14, first and second flow guides 16, 18, a base 20, and a vent pipe assembly 22. The vent cover assembly 12 includes first, second and third protective members 30, 32, 34 that each include first and second ends 36, 38 and first and second flange portions 40, 42. The assembly 12 also includes top and bottom screen members 44, 46. It should be understood that the assembly 12 may include any number of protective structural members having any suitable size and shape to provide the desired protective functions necessary for a vent cap, as will be discussed more fully below.

The protective structure members 30, 32, 34 are each coupled to the divider 14 at the flange portions 40, 42. Each of the protective members 30, 32, 34 have a semi-circular shape and a size that is substantially equal. When the members 30, 32, 34 are of the same size and shape, spaces 31, 32 between respective members 30, 32 and 32, 34 may be defined by securing the members 30, 32, 34 at different positions on the divider 14. Other embodiments may include protective members that are sized differently, such as, for example, being sized progressively larger from the bottom to the top orientated member. Such a difference in size provides a gap between the first and second members 30, 32 and between the second and third members 32, 34 for the free flow of fluid from outside the cover assembly 12 to a space 98 defined within the cover assembly 12 even when the members 30, 32, 34 are secured to divider 14 along the same plane.

The top screen 44 is positioned adjacent to the third protective structural member 34 and the bottom screen 46 is positioned adjacent to the first protective structural member 30. Although the Figures show the top and bottom screens 44, 46 positioned at an uppermost and lowermost position of the vent cover assembly 12, other embodiments may include screen members positioned at alternative locations and may include screens that have different sizes or that include only one or no screen members at all.

Figure 5:
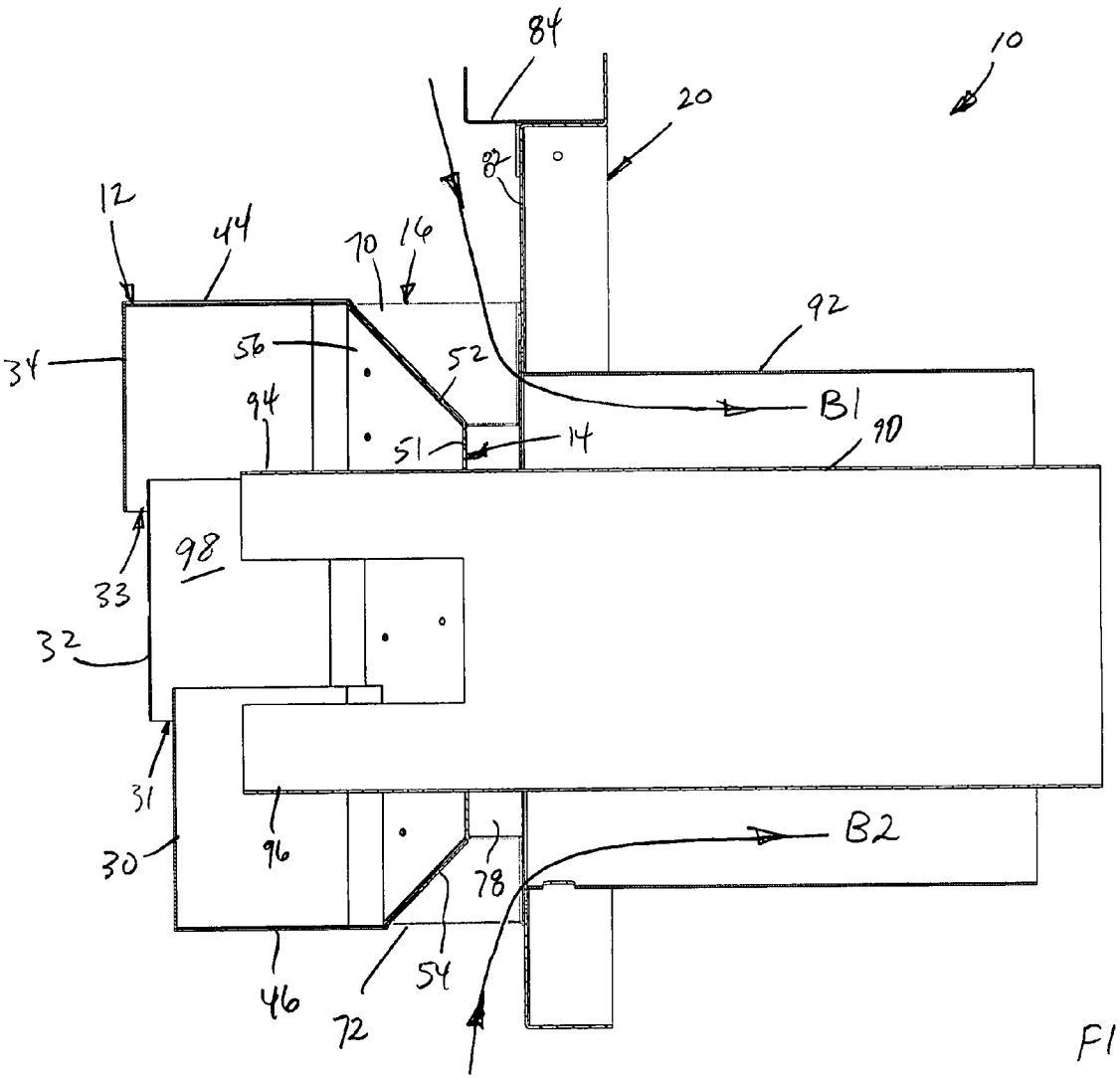
FIG. 5 is a cross-sectional view of the vent assembly shown in FIG. 4 taken along cross-sectional indicators 5—5.

The divider 14 is positioned between the base 20 and the vent cover assembly 12 and is mounted to the exhaust member 90 of the vent assembly 20 (discussed further below). The divider 14 includes a center aperture 50, top and bottom flanges 52, 54, first and second side flanges 56, 58, and first, second and third mounting surfaces 60, 62, 64 formed in each of the first and second side flanges 56, 58. The mounting surfaces 60, 62, 64 are provided at offset positions relative to each other in a horizontal direction as shown in FIG. 5, thereby providing a mounting surface for each of the first, second and third protective members 30, 32, 34, respectively. The offset nature of the mounting surfaces 60, 62, 64 provides for the spaced apart orientation of the protective members 30, 32, 34 as shown in FIGS. 1 and 3–5 in particular. The protective members 30, 32, 34 may be mounted to the divider 14 in any number of ways including, for example, using fasteners, adhesives, welding or crimping.

With the protective members 30, 32, 34 and the top and bottom screen members 44, 46 coupled to each other and to the divider 14, and the divider 14 mounted to an exterior surface of the exhaust member 90, thereby defining a volume 98 (see FIG. 5). The volume 98 is in fluid communication with an interior of the exhaust member 90 and an area outside of the vent assembly 10 via screen members 44, 46 and the spaced apart openings 31, 33.

Divider 14, when in a mounted position, is spaced apart from a guide mounting surface 82 of the base 20. The base 20 also includes an aperture 80 and a rain shield member 84. The base may be used for coupling the venting assembly 10 to a structure such as a house or a commercial building. The aperture 80 is preferably sized to receive an intake member 92 of the vent pipe assembly 22, thereby providing fluid communication between a space outside of the vent assembly 10 and an interior of the intake member 92 through the base 20. FIG. 5 illustrates fluid flow lines B1 and B2 into the intake member 92 into a space defined between the exhaust member and the intake member 92.

The divider 14 also provides separation between an open end of the exhaust member 90 and air intake aperture 80. As a result, there is provided optimal separation between the location in which the exhaust gases are vented (see openings 31, 33 and screens 44, 46 in FIG. 5) and the location in which intake air enters into the intake member 92 (see flow lines B1, B2 in FIG. 5).

To further assist in directing intake air into the aperture 80 of the base 20, the first and second flow guides 16–18 are mounted in the space defined between divider 14 and the flow guide mounting surface 82 of base 20. The flow guides 16, 18 each include first and second guides 70, 72, first and second mounting flanges 74, 76, and a divider mounting member 78. The guides 70, 72 function to direct moving air that is residing adjacent to vent assembly 10 toward the aperture 80. Although only two guides 70, 72 are provided for each flow guide 16, 18 and only two flow guides 16, 18 are shown in this embodiment, it is to be understood that more or fewer flow guides may be provided having more or fewer guide members in alternative embodiments (not shown).

The first and second mounting flanges 74, 76 of the flow guides 16, 18 may be used to mount the flow guides to the flow guide mounting surface 82 of the base 20. The divider mounting member 78 may be used to couple the flow guides 16, 18 to the divider first and second flanges 56, 58. In this way, the flow guides 16, 18 provide a positive attachment between the base 20 and the divider 14, and the divider 14 provides positive attachment of the vent cover assembly 12 to the base 20. Coupling of the flow guides 16, 18 to the base 20 and the divider 14 may be provided using any attachment means such as, for example, fasteners, adhesives, or welding.

The exhaust member 90 of the vent assembly 20 may include first and second wind shields 94, 96. The wind shields 94, 96 may be arranged and configured to shield the interior of exhaust member 90 from wind that may otherwise inhibit the free flow of exhaust gases out of exhaust member 90. Other embodiments may include more or fewer wind shields having alternative configurations that relate to the cross-sectional shape of the venting members 90, 92. The exhaust and intake members 90, 92 may have alternative cross-sectional shapes such as, for example, square, rectangle, or any other desired shape.

The various features of vent assembly 10 may be manufactured with any number of different materials such as, for example, sheet metal, ceramics, or any other suitable flame retardant and heat resistant material.

The protective members 30, 32, 34 preferably have a radius of about 4 to 8 inches and preferably about 6 to 7 inches, although any sized protective member may be used that provides proper venting and covering of the exhaust members 90, 92.

The flanges 52, 54, 56, 58 of the divider 14 are shown bent or coupled at about a 30–45 degree angle relative to the base portion 51. In other embodiments, these flange members may be bent at differing angles at anywhere from about 0 to 90 degrees relative to the plane of base member 51. The angled orientation of the flanges 52, 54, 56, 58 provide a funnel-type structure when combined with the guides 70, 72 of the flow guides 16, 18 and the flow guide mounting surface 82 of the base 80. This funnel-type structure facilitates improved flow of intake air through the aperture 80 into the interior of intake member 92.

The assembly of various features of vent assembly 10 can provide for a simple exchange of those features for purposes of replacement or modification of the vent assembly 10. For example, the protective members 30, 32, 34, if coupled to the divider 14 with fasteners, could be easily disassembled from the divider 14 and replaced with protective structural members having different sizes or shapes that are more appropriate for a certain application of the vent assembly 10 (e.g., wind conditions, pressure, pressure conditions inside and outside of the living structure, exhaust gas velocity, etc.). In another example, the flow guides 16, 18 may likewise be replaced with different flow guides 70, 72 having different configurations (e.g. different numbers of guides or shapes of guides).

An example method of assembly of a vent assembly may include providing an exhaust member that defines an exhaust aperture, and an intake member that defines an intake aperture. Steps of the method may include the positioning of a flow guide adjacent to the intake aperture, positioning a divider between the exhaust and intake apertures, and coupling a wind shield to a distal end of the exhaust member adjacent to the exhaust aperture. Further steps may include coupling a base to the intake member and coupling the flow guide to the base, covering at least a portion of the intake and exhaust apertures with a vent cap, coupling the divider to the exhaust member, or extending the divider radially out from an outer surface of the exhaust member. Still further method steps may include aligning the exhaust member coaxially with the intake member, orienting the wind shield such that it extends axially from the distal end of the exhaust member.

Another example method relates to controlling fluid flow in a vent assembly. The method includes providing an exhaust member that defines an exhaust aperture and an intake member defining an intake aperture, positioning a divider between the intake and exhaust apertures to direct exhaust fluid exiting the exhaust aperture away from the intake aperture. Further steps of this method may include coupling a wind shield to a distal end of the exhaust member adjacent to the exhaust aperture to minimize reverse flow in the exhaust aperture, positioning a flow guide adjacent to the intake aperture to direct fresh air into the intake aperture, and coupling the divider to the exhaust member whereby the divider extends radially from an outer circumference of the exhaust member.

While one particular embodiment has been described, it should be understood that the invention is not limited to the particular structure described. It is contemplated that vent assembly 10 described is typically used with a horizontal direct vent gas fireplace. However, the vent system 10 can be used to cover other types of vents such as fireplaces, furnaces, water heaters, boilers, dryers, exhaust fans, and a broad variety of other such appliances and devices. The vent system 10 allows for proper fluid flow into and from the vent pipe assembly 22. Furthermore, the vent assembly 10 improves the aesthetics.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A vent assembly, comprising:

a base configured for mounting to a wall structure, the base including a generally outward facing primary surface and defining an intake opening and an exhaust opening that extend through the outwardly facing primary surface;

an intake duct and an exhaust duct oriented in a coaxial relationship with each other and with the intake and exhaust apertures, respectively, an end of the intake duct extending no further axially than the outward facing primary surface and an end of the exhaust duct extending axially beyond the outward facing primary surface;

a divider mounted to the exhaust duct at a location between the end of the exhaust duct and the outward facing primary surface, the divider extending in a generally normal direction to an axis of the exhaust duct;

a plurality of flow guides positioned between the base and the divider to direct intake air flow into the intake aperture, at least a portion of each flow guide extending in a radial direction relative to the exhaust duct axis; and a vent cover that includes at least one protective structural member extending ax least partially around the end of the exhaust member, the vent cover being connected to the divider, the at least one structural member being configured and arranged to direct fluid flowing out of the end of the exhaust duct in a direction vertically upward or downward, wherein the at least one structural member is configured with a semi-cylindrical shape.

2. The vent assembly of claim 1, wherein the plurality of flow guide members are positioned at spaced apart locations around a circumference of the exhaust opening.

3. The vent assembly of claim 1, wherein the divider is coupled to the base through the flow guides.

4. The vent assembly of claim 1, wherein the divider is positioned adjacent to the end of the exhaust duct.

5. The vent assembly of claim 4, wherein the divider includes a flange portion at a periphery thereof that extends at an angled direction between a direction normal to the exhaust duct axis and a direction parallel to the exhaust duct axis.

6. The vent assembly of claim 1, wherein the flow guides are positioned beginning at a circumference of the intake opening and extend radially outward.

7. The vent assembly of claim 1, further comprising a wind guide coupled to the end of the exhaust duct, the wind guide extending axially in a direction away from the divider.

8. A vent assembly, comprising:

a vent duct that includes an intake member defining an air intake aperture at an end of the intake member, and an exhaust member defining an exhaust gas aperture at an end of the exhaust member, the exhaust member being positioned coaxially within the intake member, and the exhaust opening being positioned distally beyond the intake opening;

a divider mounted to the vent duct at a location between the exhaust aperture and the intake aperture, the divider extending in a direction generally perpendicular to an axis of the vent duct, the divider being configured to minimize the flow of exhaust gases from the exhaust aperture into the intake aperture; and a cover member mounted to the divider and configured to cover at least a portion of the exhaust aperture, wherein the cover member does not extend into a space defined between the divider and the intake aperture.

9. The vent assembly of claim 8, wherein the cover member includes at least one semi-cylindrical member that is coupled to the divider.

10. The vent assembly of claim 8, further comprising a flow guide positioned between the divider and the intake aperture to direct intake air flow into the intake aperture.

11. The vent assembly of claim 10, wherein the flow guide extends in a direction perpendicular to the axis of the vent duct.

12. The vent assembly of claim 8, wherein an end of the exhaust member extends axially beyond an end of the intake duct, and the divider is coupled with the exhaust member around an outer surface of the exhaust member adjacent to the end of the exhaust member.

13. The vent assembly of claim 8, further comprising a wind guide extending from an end of the exhaust member in a direction parallel with the axis of the vent duct and being configured to prevent reverse flow into the exhaust aperture.

14. A vent assembly for use with a vent that includes an intake member defining an intake aperture in an end of the intake member and an exhaust member defining an exhaust aperture in an end of the exhaust member, the end of the exhaust member extending distally beyond the end of the intake member, the assembly comprising:

a plurality of flow guides positioned adjacent to the intake aperture around a circumference of the intake aperture, at least a portion of the flow guides extending radially from a longitudinal axis of the vent, the flow guides being configured to direct fluid flow into the intake aperture;

a divider mounted to the exhaust member at a location between the exhaust aperture and the intake aperture, the divider being configured and arranged to minimize fluid flow between the exhaust aperture and the intake aperture; and a wind shield extending axially from a distal end of the exhaust member adjacent to the exhaust aperture, the wind shield being configured to minimize fluid flow into the exhaust aperture;

wherein at least a portion of the flow guides extend axially film the intake aperture at the end of the intake member to the divider.

15. The assembly of claim 14, further comprising an attachment base defining an aperture sized to receive the intake member in a flush mounted arrangement, and the exhaust member extends coaxially with the intake member distally beyond the attachment base.

16. The assembly of claim 15, wherein the divider is coupled to that portion of the exhaust member extending distally beyond the attachment base.

17. The assembly of claim 14, wherein the wind shield includes first and second elongate members that are spaced apart around a circumference of the exhaust aperture, the elongate members each comprise a semi-cylindrical cross-section.

18. A vent assembly for use with a vent that includes an intake member defining an intake aperture in an end of the intake member and an exhaust member defining an exhaust aperture in an end of the exhaust member, the end of the exhaust member extending distally beyond the end of the intake member, the assembly comprising:

a plurality of flow guides positioned adjacent to the intake aperture around a circumference of the intake aperture, at least a portion of the flow guides extending radially from a longitudinal axis of the vent, the flow guides being and configured to direct fluid flow into the intake aperture;

a divider mounted to the exhaust member at a location between the exhaust aperture and the intake aperture, the divider being configured and arranged to minimize fluid flow between the exhaust aperture and the intake aperture;

a wind shield extending axially from a distal end of the exhaust member adjacent to the exhaust aperture, the wind shield being and configured to minimize fluid flow into the exhaust aperture; and a cover member connected directly to the divider and configured to extend laterally around the exhaust opening, wherein the cover member includes at least two semi-cylindrical member that are spaced apart.

* * * * *

UNITED STATES PATENT AND TRADEMARK OFFICE

CERTIFICATE OF CORRECTION

PATENT NO. : 7,074,121 B2
APPLICATION NO. : 10/888338
DATED : July 11, 2006
INVENTOR(S) : Yingying Zhou et al.

It is certified that error appears in the above-identified patent and that said Letters Patent is hereby corrected as shown below:

Column 8

Line 19, delete “film” and insert therefore --from--

Line 59, delete “member” and insert therefore --members--

Signed and Sealed this

Twenty-sixth Day of December, 2006

JON W. DUDAS
*Director of the United States Patent and Trademark Office*